US006471005B1

(12) United States Patent
Zager

(10) Patent No.: US 6,471,005 B1
(45) Date of Patent: Oct. 29, 2002

(54) OIL CHANGE SYSTEM FOR ROAD VEHICLES

(76) Inventor: Raymond Zager, 3010 Old Barn Rd. - P.O. Box 2657, Ponte Vedra Beach, FL (US) 32004

( * ) Notice: Subject to any disclaimer, the term of this patent is extended or adjusted under 35 U.S.C. 154(b) by 241 days.

(21) Appl. No.: 09/127,198

(22) Filed: Jul. 31, 1998

(51) Int. Cl.[7] ..... F01M 11/04
(52) U.S. Cl. ..... 184/1.5; 184/105.1
(58) Field of Search ..... 184/1.5, 108, 6.4; 251/315.01, 315.06

(56) References Cited

U.S. PATENT DOCUMENTS 3,614,346 A * 10/1971 Gudaitis ..... 200/16 R
3,743,053 A * 7/1973 Kuklewicz ..... 184/1.5
4,240,523 A 12/1980 Nestor et al.
4,792,118 A * 12/1988 Yusko, Jr. et al. ..... 251/315
5,203,429 A 4/1993 Zager

OTHER PUBLICATIONS

Instruction Sheet "How To Install Your New Universal Oil Filter Relocation Kit" P.W. Diederich (Author) c 1996 1234010 (Rev. 1) Perma–Cool—Covina, CA 91723–1314.

* cited by examiner

*Primary Examiner*—David A. Bucci
*Assistant Examiner*—Colby Hansen
(74) *Attorney, Agent, or Firm*—Arthur G. Yeager

(57) ABSTRACT

A distributed system for draining and filling oil reservoirs in engines includes an electrically powered reversible pump, a relocated oil filter, a shutoff valve and a plurality of hoses to direct oil through the pump and valve to drain or fill the engine. The pump, valve and oil filter are located remote from each other preferably adjacent the top of the engine to be readily accessible from above without lifting the vehicle.

12 Claims, 2 Drawing Sheets

OIL CHANGE SYSTEM FOR ROAD VEHICLES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates to engine maintenance equipment and more particularly to a motorized system for draining and refilling crankcase oil for use as a permanent installation for road vehicles and having safety lock capability for controls.

2. Description of Related Art

Various devices are known to the prior art that seek to alleviate the inconvenience of oil changes. Often it is necessary for one to get under a vehicle, open by jacking the vehicle upward, in order to remove the oil plug in the oil pan. In addition, the oil filter itself is often inaccessible without lifting of the vehicle. Motorized systems have been proposed, for example, see U.S. Pat. Nos. 4,240,523 and 5,203,429.

There remains a need for an oil changing apparatus where all the components of the system, whether a motorized pump, electric valve control, or oil filter are all distributed throughout the engine compartment and are readily accessible.

BRIEF SUMMARY OF THE INVENTION

In one aspect of the present invention there is provided a distributed system for draining and refilling oil in a road vehicle engine within an engine compartment which includes an oil filter, an oil pan having an oil outlet port, and a removable drain plug installable in the outlet port, comprising first hose means having first and second end portions, the first end portion being connected to the oil outlet port for providing oil into or out of the oil pan, a reversible electrically-powered pump means located remotely from the oil pan and having a first port and a second port, the second end portion of the first hose means being connected to the first port of the pump means, second hose means having a first end portion and a second end portion, the first end portion of the second hose means being connected to the second port of the pump means, valve means located remotely from the pump means and the oil pan. The valve means has a first port and a second port, the second end portion of the second hose means being connected to the first port of the valve means for controlling oil flow in the second hose means. Third hose means is connected to the second port of the valve means for directing oil to and away from the valve means, and an electric power means operatively connected to the pump means, the pump means operative in one direction to cause drainage of oil through the oil outlet port, the first hose means, the pump means, the second hose means, the valve means and the third hose means and adapted for collection in a container for disposal or recycle. The pump means is operative in a reverse direction to pump new oil from a container in a manner opposite to the one direction whereby new oil is introduced into the oil pan through the oil outlet port.

In other aspects of the invention the electric power means includes switch means for controlling electric power to the pump means, the switch means having a first position for operating the pump means to direct oil to the oil pan, a second position for operating the pump means to drain oil from the oil pan, and a third position for interrupting electric power to the pump means. The switch means is biased to return to the third position when it is released by an operator. The switch means includes positive locking means operable to inhibit inadvertent operation of the switch means.

The valve means includes a ball valve and a ball valve handle for operating the ball valve between open and closed positions. The switch means includes a switch for controlling electric power to the pump means. The switch means includes positive locking means attached to the valve handle and movable to a first position to simultaneously inhibit inadvertent operation of the switch and to close the ball valve, the locking means being movable to a second position to simultaneously allow for operation of the switch means and to open the valve.

In another aspect of the invention, an oil filter relocation means is provided for relocating the oil filter from a generally inaccessible position adjacent the engine lower portion to a position readily accessible within the compartment or for relocating an oil filter from a first lower position on the engine to a readily accessible second higher position on the engine. The pump means, valve means, and oil filter are located adjacent a top portion of an engine.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
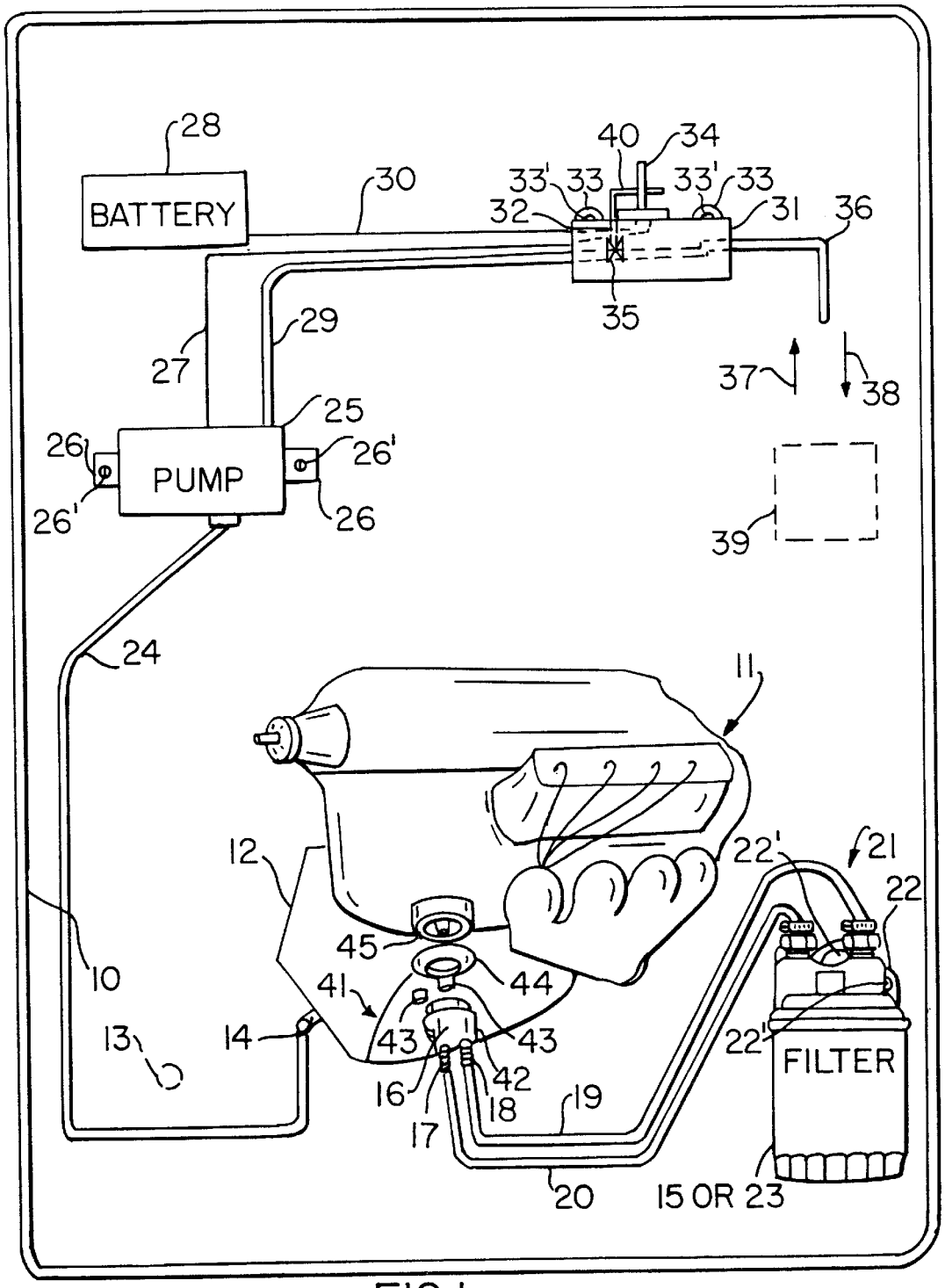
FIG. 1 is a pictorial view of an engine in an engine compartment illustrating the distributed oil changing system in accord with the present invention.

Referring now to the drawing, an engine compartment firewall structure 10 houses an engine 11 connected to the vehicle frame (not shown). The engine 11 may be diesel or gasoline, has an oil pan 12 with an outlet port 14 normally closed via a oil pan plug 13 (shown removed). An oil filter 15 has been removed from its normal location and replaced with an adapter 16 having an outlet fitting 17 and an oil return fitting 18 that are connected to respective return and outlet hoses 19 and 20 respectively. Oil filter relocation kit assembly 21 includes adapter 16, hoses 19 and 20 and filter mounting bracket 22 and bolts 22' that includes inlet and outlet fittings and other associated hardware such as hose clamps to mount the apparatus to firewall 10 as understood in the art. The oil filter 15 is the original filter. A replacement oil filter 23 may be used if desired. Kit assembly 21 is well known in the art and may be an assembly sold by Perma-Cool, a California company.

Fill/drain hose 24 is connected to an electrically powered reversible pump 25 held to wall 10 via brackets 26 and screws 26'. The pump 25 receives 12 vdc power by a connection 27 from vehicle battery 28 via valve and switch assembly housing 31. Pump inlet/outlet hose 29 connects between pump 25 and valve and switch assembly housing 31 that also routes 12 vdc power via connector 30 from battery 28 to the pump 25.

Valve and switch assembly housing 31 is mounted on firewall 10 via brackets 33 and screws 33'. A toggle switch 34 controls power to pump 25. Switch 34 is a three-position momentary switch that controls the forward/reverse operation of pump 25. Assembly hose connection 36 provides for oil flow as shown by fill arrow 37 or drain as indicated at arrow 38 via shutoff ball valve 35. Container 39 may either provide or receive oil.

Switch 34 preferably has a safety latch 40 that doubles as the handle for ball valve 35 that must be swiveled out of the way for system operation. The latch 40 is moved to open valve 35 and to allow for operation of switch 34. Switch 34 is shown in a first position off. A second position is used to fill the engine 11 with oil. A third position is used to drain. The switch 34 is a momentary spring-return-to-off device that requires it to be held in the desired position during operation. This feature cooperates with latch 40 to prevent inadvertent and/or unintended operation of the switch 34 and can keep valve 35 closed at the same time.

Adapter apparatus 41 is part of the relocation kit 21 and includes engine adapter plate 42, a plurality of different bushings 43, an additional adapter plate 44 that can be used if necessary depending upon the size of filter landing 45 and hoses, clamps, and fittings, etc. that are all standard items known in the art.

Figure 2:
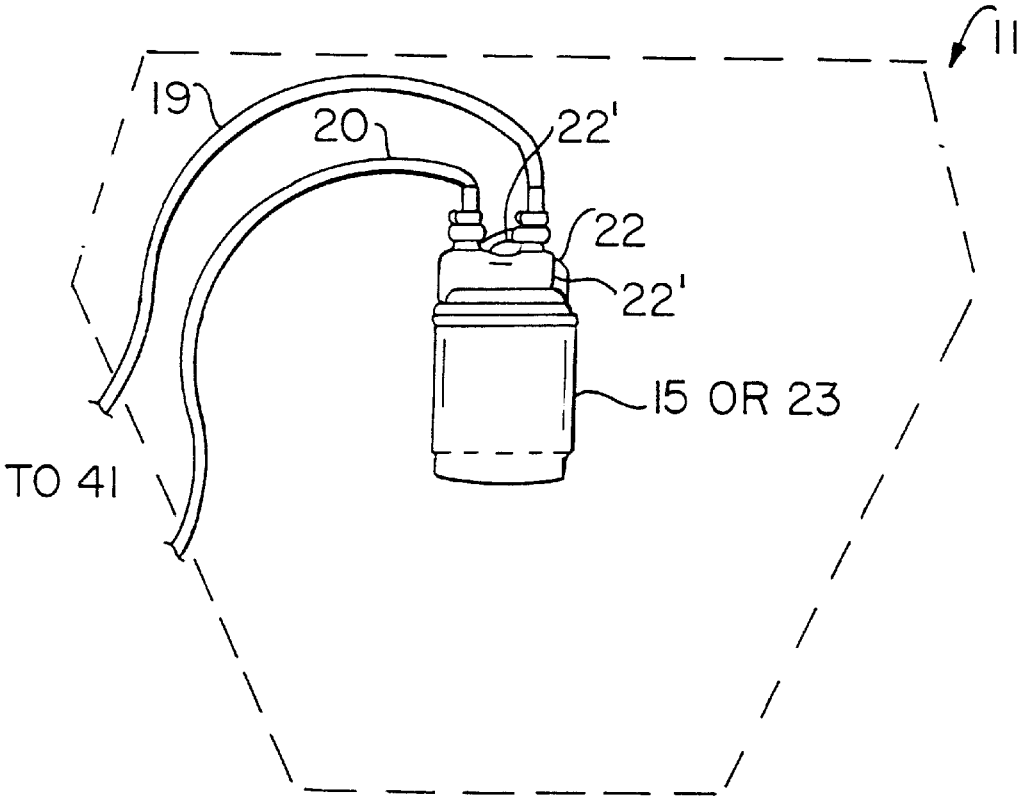
FIG. 2. is a diagrammatic view of the rear of an engine illustrating an alternative mounting of an oil filter in accord with the present invention.

The principal advantage of the illustrated preferred embodiment of the invention shows that filter 15 or 23, pump 25, and shutoff ball valve 35 in housing 31 are each distributed throughout the engine compartment and secured to wall 10 or engine 11 in a manner to be readily accessible to a user. Presently, central units such as those disclosed in the cited art cannot be readily placed inside engine compartments of road vehicles and in many cases would simply not fit at all. The components are shown attached to wall 10 but can be mounted to the engine 11 block at a position higher than the original position if space permits and engine fittings such as bolt holes exist as shown in FIG. 2. All components are accessible by lifting the vehicle hood (not shown) and therefore no lifting of the vehicle or underneath access is required.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A distributed system for draining and refilling oil in a road vehicle engine within an engine compartment which includes an oil filter, an oil pan having an oil outlet port, and a removable drain plug installable in the outlet port, comprising first hose means having first and second end portions, said first end portion being connectable to the oil outlet port for providing oil into or out of the oil pan, a reversible electrically-powered pump means located remotely from said oil pan and having a first port and a second port, said second end portion of said first hose means being connected to said first port and said pump means, second hose means having a first end portion and a second end portion, said first end portion of said second hose means being connected to said second port of said pump means, valve means located remotely from said pump means and the oil pan, said valve means having a first port and a second port, said second end portion of said second hose means being connected to said first port of said valve means for controlling oil flow in said second hose means, third hose means being connected to said second port of said valve means for directing oil to and away from said valve means, an electric power means operatively connected to said pump means, and switch means including a switch for controlling electric power to said pump means, said switch means having a first position for operating said pump means to direct oil to the oil pan, said switch means having a second position for operating said pump means to drain oil from the oil pan, said switch means having a third position for interrupting electric power to said pump means, said switch means being biased to return to said third position when it is released by an operator of said switch means for requiring continuous attendance of an operator when said system is being operated, said switch means and said valve means being located in a housing attached within the engine compartment in a readily accessible location above the engine, said pump means attached within the engine compartment remotely outside said housing, said pump means operative in one direction for causing drainage of oil through the oil outlet port, said first hose means, said pump means, said second hose means, said valve means and thence through said third hose means and adapted for collection in a container for disposal or recycle, said pump means operative in a reverse direction for pumping new oil from a container in a manner opposite to said one direction whereby new oil can be introduced into the oil pan through the oil outlet port.

2. The system as defined in claim 1 wherein said switch means includes positive locking means operable to inhibit inadvertent operation of said switch means.

3. The system as defined in claim 1 wherein said valve means includes a ball valve and a ball valve handle for operating said ball valve between open and closed positions.

4. The system as defined in claims 3 wherein said switch means includes positive locking means attached to said valve handle and movable to a first position to simultaneously inhibit inadvertent operation of said switch and to close said ball valve, said locking means being movable to a second position to simultaneously allow for operation of said switch means and to open said valve.

5. The system as defined in claim 1 further including oil filter relocation means for relocating the oil filter from a generally inaccessible position adjacent the engine lower portion to a position readily accessible within the compartment.

6. The system as defined in claim 5 wherein said pump means, said valve means, and the oil filter are locatable adjacent a top portion of an engine.

7. The system as defined in claim 1 further including oil filter relocation means for relocating an oil filter from a first lower position on the engine to a readily accessible second higher position on the engine.

8. A distributed system for draining and refilling the oil in a road vehicle engine mounted in an engine compartment which includes an oil filter attached to a lower portion of the engine, and an oil pan having an oil outlet port and a removable drain plug installable in the outlet port, comprising reversible electrically-powered pump means for pumping oil into or out of the outlet port of the oil pan and having a first port and a second port, first hose means being connected between the oil outlet port and said first port of said pump means, valve means having a first and second port and being located remotely from said pump means and the oil pan, second hose means being connected between said second port of said pump means and said first port of said valve means, said valve means being operable to provide for control of oil flow to and from said pump means, and third hose means being connected to said second port of said valve means to provide for conducting oil to and from said valve means, electric power means operably connected to said pump means, and switch means for controlling said electric power means to control said pump means said switch means and said valve means being located in a housing attached within the engine compartment in a readily accessible location above the engine, said pump means attached within the engine compartment remotely outside said housing.

9. The system as defined in claim 8 further including oil filter relocation means for locating an oil filter remotely from an engine and said pump means and said valve means.

10. The system as defined in claim 8 further including oil filter relocation means for locating an oil filter on the engine remotely from an original lower position.

11. The system as defined in claim 8 further including a plurality of securing means for securing said pump means and said valve means adjacent a top portion of an engine.

12. A distributed system for draining and refilling the oil in a road vehicle engine within an engine compartment which includes an oil filter, and an oil pan having an oil outlet port and a removable drain plug installed in the outlet port, comprising an oil filter relocation means for relocating an oil filter from a first position to a second position, first hose means having a first and second end portion, said first end portion being connected to the oil outlet port for providing oil out of the oil pan, reversible electrically-powered pump means for pumping oil into or out of the outlet port of the oil pan, having a first port and a second port, said second end portion of said first hose means being connected to said first port of said pump means, second hose means having a first end portion and a second end portion, said first end portion of said second hose means being connected to said second port of said pump means, valve means having a first port and a second port, said second end portion of said second hose means being connected to said first port of said valve to provide for controlling oil flow in said second hose means, third hose means being connected to said second port of said valve means to provide for directing oil to and away from said valve means, and electric power means operatively connected to said pump means, and switch means including a switch for controlling electric power to said pump means, said switch means including positive locking means attached to said valve handle movable to a first position to simultaneously inhibit inadvertent operation of said switch and to close said valve means, said locking means being movable and operable to a second position to simultaneously allow for operation of said switch and to open said valve means;

wherein said electric power means includes switch means including a switch for controlling electric power to said pump means, said switch means and said valve means being located in a housing within the engine compartment in a readily accessible location above the engine, said pump means being attached with the engine compartment remotely outside from said first housing.

* * * * *